United States Patent [19]

Kikuchi et al.

[11] Patent Number: 4,940,127

[45] Date of Patent: Jul. 10, 1990

[54] WOUND YARN PACKAGE TRANSPORTING SYSTEM

[75] Inventors: Shuichi Kikuchi, Shiga; Yoshihiko Kawasaki, Kyoto, both of Japan

[73] Assignee: Murata Kikai Kabushiki Kaisha, Kyoto, Japan

[21] Appl. No.: 130,307

[22] Filed: Dec. 9, 1987

[30] Foreign Application Priority Data

Dec. 12, 1986 [JP] Japan ..... 61-296429
Dec. 23, 1986 [JP] Japan ..... 61-198052[U]
Dec. 25, 1986 [JP] Japan ..... 61-202559[U]

[51] Int. Cl.[5] ..... B65G 47/48

[52] U.S. Cl. ..... 198/350; 198/465.1; 242/35.5 A; 209/927

[58] Field of Search ..... 198/340, 346.1, 346.2, 198/349, 350, 358, 465.1, 465.4, 485.1, 487.1, 803.12; 292/35.5 A, 130, 130.1, 130.2, 131, 131.1; 209/927 X, 569; 104/88; 414/136

[56] References Cited

U.S. PATENT DOCUMENTS 3,168,053 2/1965 Miroux ..... 198/350 X
3,200,933 8/1965 Schenk et al. ..... 198/350
3,307,162 2/1967 Fink ..... 198/350 X
4,515,328 5/1985 Payne, Jr. ..... 198/487.1 X
4,681,231 7/1987 Ueda et al. ..... 209/927 X
4,730,733 3/1988 Kawamura et al. ..... 198/487.1 X
4,763,773 8/1988 Kawarabashi et al. ..... 242/35.5 X

FOREIGN PATENT DOCUMENTS 2230801 1/1974 Fed. Rep. of Germany ..... 242/35.5 A
0865703 4/1961 United Kingdom ..... 198/350

*Primary Examiner*—Robert J. Spar
*Assistant Examiner*—James R Bidwell
*Attorney, Agent, or Firm*—Spensley, Horn, Jubas & Lubitz

[57] ABSTRACT

A system for transporting a wound yarn package is constituted such that transport media for independently transporting packages thereon are fed along a transport line between winders an inspecting station and each has provided thereon a source indicating member on which information of a particular one of the winders or a particular winding unit on which a package which is to be placed on the transport medium has been produced is to be written in order to indicate such information.

9 Claims, 10 Drawing Sheets

WOUND YARN PACKAGE TRANSPORTING SYSTEM

FIELD OF THE INVENTION

This invention relates to a system for transporting a wound yarn package.

RELATED ART STATEMENT

An automatic winder is used, for example, for a step of rewinding a spinning bobbin. Such an automatic winder may be of a type called a single spindle type wherein a plurality of winding units are fixedly installed in a juxtaposed relationship, or of another type called a circulating type wherein a plurality of winding units are circulated along a predetermined path, or of some other type. Anyway, a large number of such automatic winders are installed in a spinning mill to produce wound yarn packages of a predetermined shape having a predetermined amount of yarn thereon. Fully wound packages doffed from such winders are then transported to a subsequent step or a subsequent working station for inspection, packaging, shipment or the like by way of various transporting means.

In such a transporting system, particularly at a station for inspection of packages, conditions of surfaces of yarn layers on packages are checked either by observation by eyesight of an operator or by an optical inspecting instrument, and rejected packages are then removed from a transport line and forwarded into a reservoir area. In this manner, packages produced are only checked at the package inspecting station. Particularly where such rejection of packages arises from a mechanical defect of one of the automatic winders, the automatic winder will repetitively produce such rejected packages. Consequently, rejected packages to be removed as a result of checking will be accumulated by a great amount in the reservoir area.

OBJECT AND SUMMARY OF THE INVENTION

It is an object of the present invention to provide a transport system which can trace and control packages from a doffing station to an inspecting station and a transport means for packages.

According to an embodiment of the present invention, a system for transporting a wound yarn package is constituted such that transport media for independently transporting packages thereon are fed along a transport line between winders and an inspecting station and each has provided thereon a source indicating member on which information of a particular one of the winders or a particular winding unit on which a package which is to be placed on the transport medium has been produced is to be written in order to indicate such information, and a writing device for writing information of a source on the indicating member is located at a package delivery position from each of the winders to the transport line while a reading device for reading the indication on a transport medium is located at a package delivery position from the transport line to the inspecting station, whereby an automatic winder or winding unit on which a package transported and supplied to the inspecting station has been produced can be grasped and identified.

The transport media for transporting packages may be hangers hung on a chain which travels along a track or package transporting trays.

The hanger has at least one pair of package supporting rods which extends in a direction parallel to the direction of movement of the hanger and are spaced by a predetermined distance from each other, whereby a package is transported in a condition wherein an outer peripheral surface of a layer of yarn on the package is placed on the supporting rods.

In an embodiment of the system of the present invention, at a branch point between a main transport line for transporting the tray and a branch line branched from the main transport line for storing and transporting package thereon, a package transferring device for separating a package from a tray on the main transport line and for transferring only the package to the branched line may be located.

PREFERRED EMBODIMENTS OF THE INVENTION

Now, embodiments of the present invention will be described with reference to the drawings.

Figure 1:
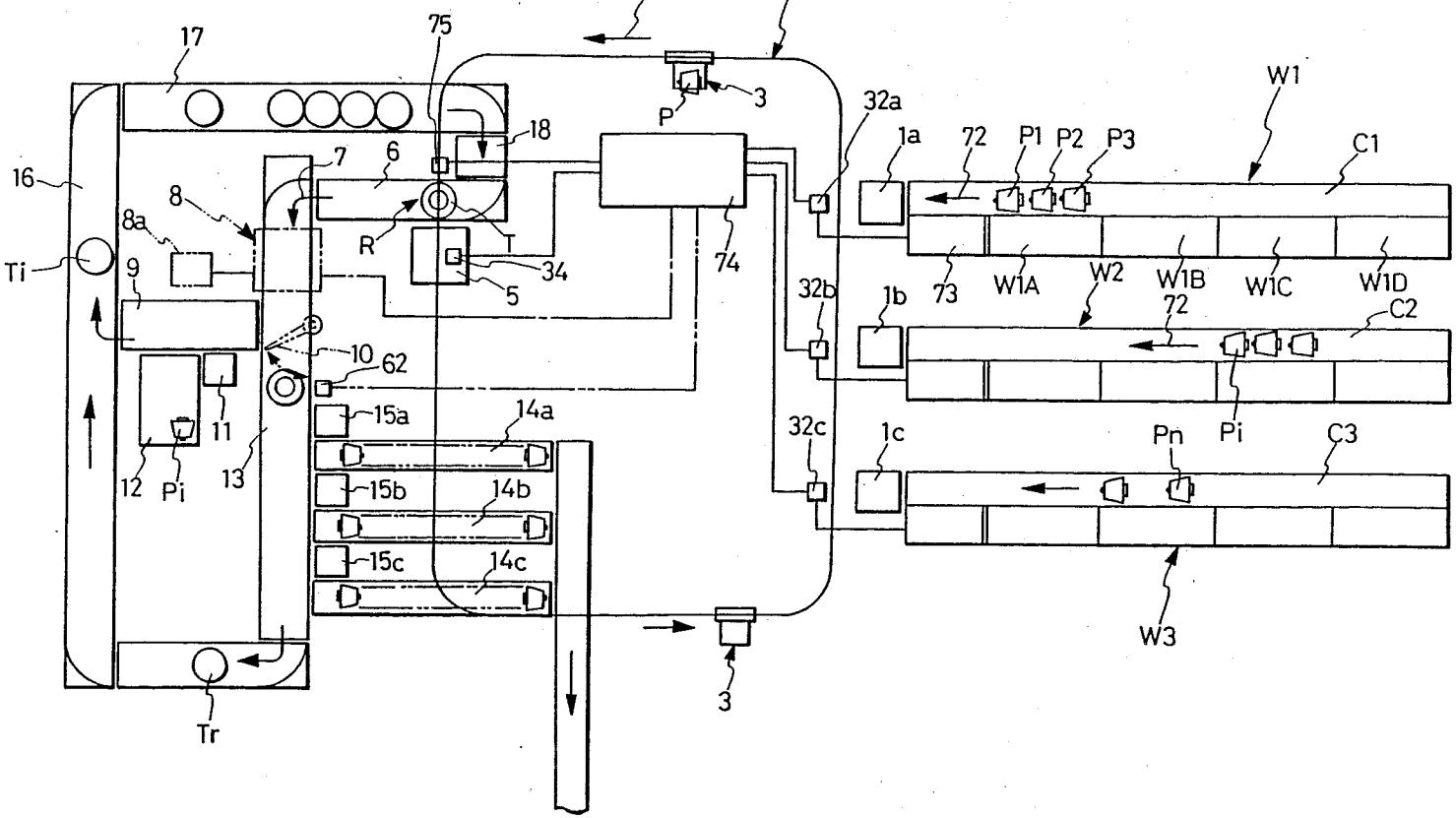
FIG. 1 is a layout view in plan showing an embodiment of system of the present invention, FIG. 2 a side elevational view showing an example of hanger serving as a transport medium for a package, FIG. 3 a front elevational view of the hanger of FIG. 2, FIG. 4 an illustrative view showing an example of information of a source, FIG. 5 a plan view showing an example of tray serving as a transport medium, FIG. 6 a cross sectional view illustrating a relationship between a writing device and a tray, FIG. 7 a cross sectional view illustrating a relationship between a reading device and a tray.

FIG. 1 shows an example of layout of a package transporting system. Reference symbols W1, W2 and W3 denotes each an automatic winder which includes a plurality of winding spans W1A to W1D each of which in turn includes a plurality of winding units as minimum units arranged in a juxtaposed relationship.

Fully wound packages Pl to Pn doffed by the winders W1, W2 and W3 are transported to end portions of the automatic winders by transport conveyors C1 to C3 extending along the winding units of the winders W1 to W3, respectively. The packages Pl to Pn are then lifted by package lifting devices 1*a*, 1*b* and 1*c* located adjacent the end portions of the automatic winders and then transferred to package hangers 3 of an overhead conveyor 2 which is provided for circulation at a high location.

Each of the packages P transported by circulation of the conveyor 2 in a direction of an arrow mark 4 is then transferred to or fitted onto a package transporting tray T waiting on another conveyor 6 below at the position of an unloading device 5. After then, the package is transported in a direction of an arrow mark 7 together with the tray T and supplied to a package inspecting station 8. At the package inspecting station, the package is inspected for predetermined checking items in order to determine whether it is acceptable or to be rejected. If the package is determined to be rejected, it is then introduced into a branch path 9 by a movable guide 10. In the branch path 9, the rejected package Pi is pulled off the tray and placed into a box 12 by a package pulling off device 11. On the contrary, if the package is determined to be acceptable, it is discharged from the inspecting station 8 and transferred to a further conveyor 13 on which it is separated from the tray Tr by one of package transferring devices 15*a* to 15*c*. Then, the package is placed onto and thereafter stored on a corresponding one of package stock lines 14*a* to 14*c*. The empty tray Tr or Ti from which the package has been pulled off is transported back to a package receiving position R by conveyors 16, 17 and 18 and so on in order to prepare for subsequent reception of another package.

Figure 2:
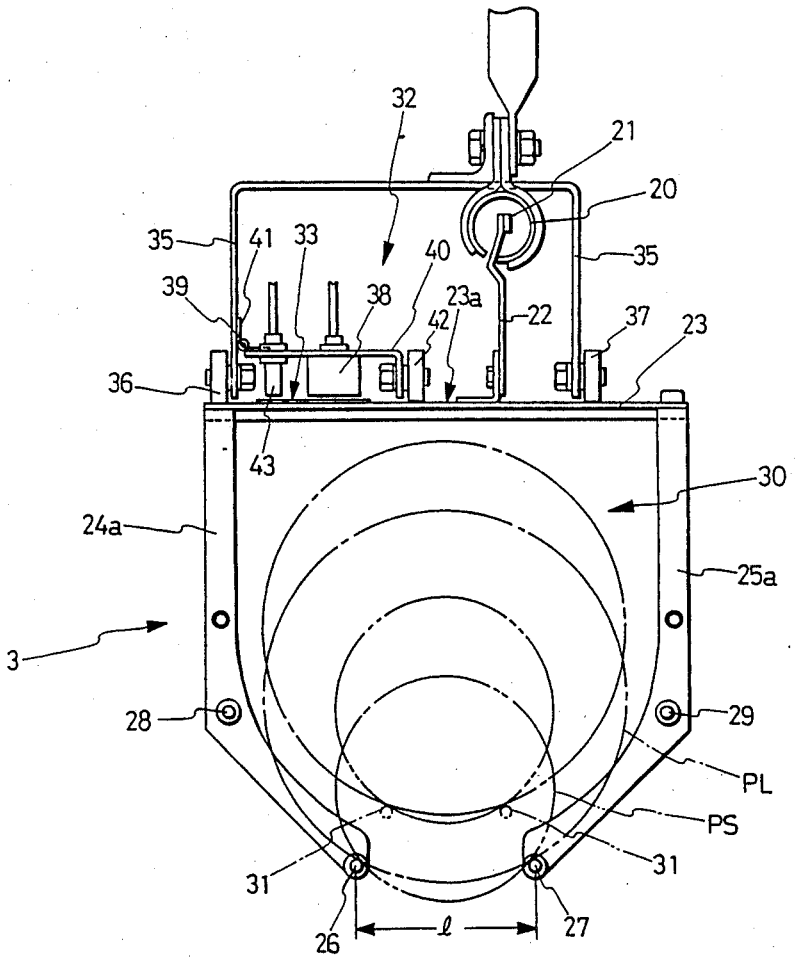
Figure 3:
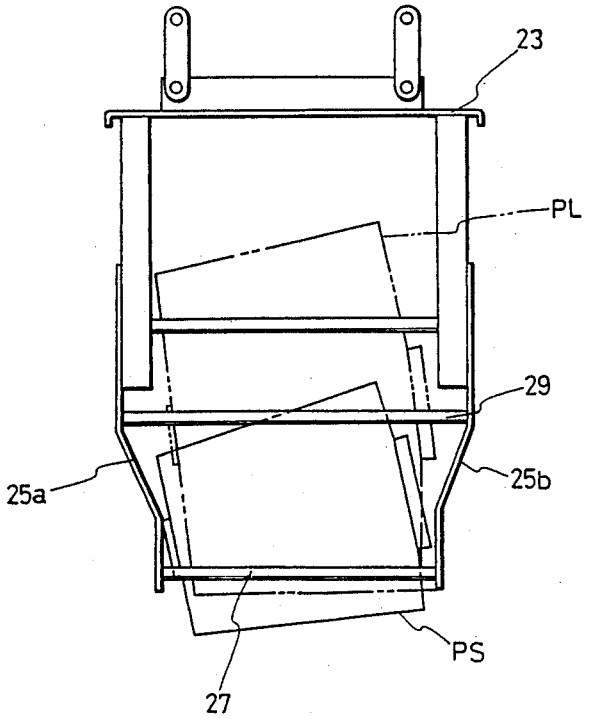

An example of package hanger 3 hung on the overhead conveyor 2 and an example of tray T for feeding a package to the inspecting station 8 are shown in FIGS. 2 to 7. FIGS. 2 and 3 show a hanger 3. The hanger 3 is hung on a chain 21 traveling along a track 20 by means of a support member 22. The hanger 3 includes a base plate 23 at an upper portion thereof, package support members 24*a*, 24*b*, 25*a* and 25*b* secured to a lower face of the base plate 23, a pair of package placing rods 26, 27 connected between lower end portions of the support members, and a pair of intermediate support rods 28, 29. Thus, an opening 30 for allowing separation of the hanger and a package is defined between opposite sides of the hanger with respect to a package transporting direction. The distance l between the package placing rods 26, 27 is dimensioned so as to allow a pair of liftable support members 31 for delivering a package to the hanger to pass therethrough and also dimensioned so that the lower end of a layer of yarn on a package at the package delivery position may assume a substantially fixed position whether the package has a large size PL or a small size PS. With such a hanger 3 described just above, any package can be transported whichever size and whichever shape such as a shape of a cone or a cheese it has. To the contrary, where a hanger which employs, for example, an L-shaped hook is used, either it is necessary to reverse the orientation of a supporting peg of the L-shaped hook at a package receiving position and an unloading position when a package is to be delivered upon movement of the hanger, or if the orientation of such a supporting peg is not reversed, a delivery device at the package receiving position and the unloading position is complicated in construction.

With the hanger 3 described above, only if such liftable support members 31 of FIG. 2 are provided at each of the package receiving and unloading positions, delivery of a package can be conducted readily.

Referring to FIG. 2, reference numeral 32 denotes a writing device for writing on an identifying member 33 of the hanger 3, and the writing devices 32*a*, 32*b*, 32*c* are provided for the package delivery positions 1*a*, 1*b* and 1*c* of FIG. 1, respectively. It is to be noted that a reading device 34 provided at the unloading position 5 of FIG. 1 has a substantially similar construction. In particular, a pair of guide rollers 36, 37 are supported for rotation on a pair of brackets 35 secured to the guide rail 20 and are contacted with an upper face 23*a* of the base plate of the hanger to control the base plate 23 to a horizontal position. At a location opposing to the indicating member 33 securely mounted on the upper face of the base plate of the hanger for indicating information of a source of a package thereon, a writing head 38 for writing such information is provided. The writing head 38 is secured to a bracket 40 which is in turn mounted for rocking motion in upward and downward directions around a fulcrum of a shaft 39 on one of the brackets 35. The bracket 40 is lightly urged downwardly by a spring 41. The distance between the writing head 38 and a surface of the indicating member 33 is maintained constant by a guide roller 42 supported at an end portion of the bracket 40, thereby making a writing operation of the writing head 38 sure. Reference numeral 43 denotes a contactless sensor which detects arrival of a hanger 3 at a predetermined position and develops a timing signal for writing.

Figure 4:
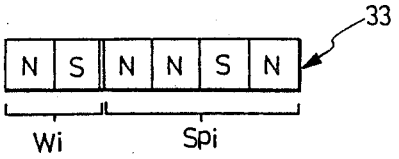

The indicating member 33 may be formed, for example, from a freely magnetizable and demagnetizable rubber magnet. In particular, the rubber magnet may have a plurality of zones which are individually magnetized to north (N) or south (S) poles or demagnetized so as to indicate a source of a package. For example, in the case of FIG. 1, if it is intended to indicate on which span of which automatic winder a package is produced, the rubber 33 may have up to 6 zones wherein the first two zones may represent the number Wi of an automatic winder and the remaining four zones represent the number SPi of a span. Thus, for a package Pi doffed at the span SP3 (see FIG. 8) of the winder W2 of FIG. 1, the rubber material 33 may be magnetized in a pattern of NSNNSN as shown in FIG. 4. Naturally, the number of a winding unit may be written in place of the number of a span SPi.

Figure 5:
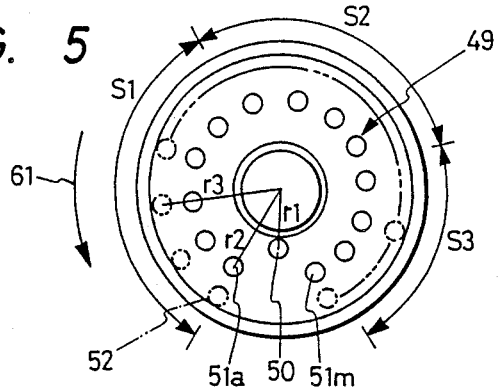
Figure 6:
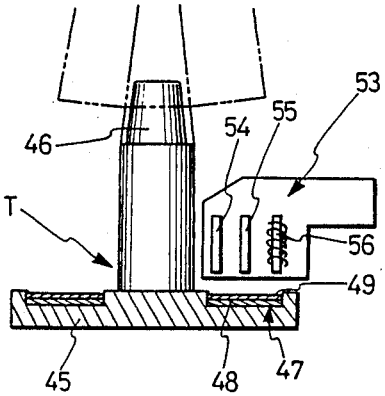
Figure 7:
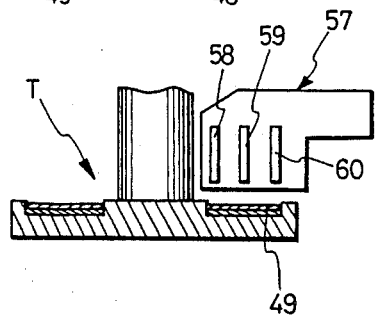

FIGS. 5 to 7 show an example of indicating member applied to a package transporting tray T at the inspecting station 8 and examples of writing and reading devices for such an indicating member, respectively.

In particular, the tray T includes a base member 45 in the form of a disk and a peg 46 formed on the base member 45 for receiving a bobbin thereon. Preferably, the tray T is formed as a unitary member from a non-conductive material such as a synthetic resin material.

An annular groove or channel 47 is formed on an upper face of the disk-formed base member 45 of the tray T, and an iron plate 48 for promoting magnetization is fixedly mounted in the groove. An identifying information indicating member in the form of a rubber magnet sheet 49 is fixedly mounted on the iron plate 48. Ferrite powder is contained in the rubber magnet sheet 49 so that if a magnet approaches the rubber magnet sheet 49, the rubber magnet sheet 49 can be magnetized arbitrarily thereby.

As illustrated in FIG. 5, a magnetized portion 50 is formed at a location on a circle of a radius r1 of the tray so as to provide a start signal for writing or reading of information while magnetized portions 51*a* to 51*m* are formed in advance in a predetermined equal pitch on another circle of another radius r2 so as to provide clock signals indicative of positions to write or read information.

Further, magnetizable portions 52 on which identifying information of a package is to be written are formed on a further circle of a different circle r3. In the embodiment shown in FIG. 5, the portions on which identifying information is to be written are divided into 3 sections S1 to S3 in each of which the number of an automatic winder and the number of a span on which a package to be fitted on the tray is produced.

A head 53 for writing on such a tray as described above may be such as shown in FIG. 6 wherein two magnetic sensors 54, 55 and a writing magnet 56 are arranged in a row in a radial direction of the tray while a reading head 57 may be such as shown in FIG. 7 wherein 3 magnetic sensors 58, 59, 60 are arranged in a row in a radial direction of the tray. The heads 53, 57 are mounted either for movement or stationarily in a spaced relationship by a predetermined distance from a surface of the rubber magnet 49 on the upper face of a tray at the writing and reading positions for a tray, respectively. The magnetic sensors 54, 58 are provided for reading the start signal 50 on a tray, and the magnetic sensors 55, 59 are provided for reading the clock signals 51*a* to 51*m* while the magnetic sensor 60 is provided for reading identifying information of a bobbin. It is to be noted that a tray is rotated in a direction of an arrow mark 61 when information is written onto or read from the tray.

While the reading device 34 is located at the package unloading position, another reading device for reading information written on a tray may be located at the package inspecting station 8. In this instance, it is convenient to provide the reading device where the distance between the unloading device 5 and the inspecting station 8 is relatively great so that there exist two or more packages exist therein. To the contrary, where a package is supplied directly from the unloading position to the inspecting station, information of the source of the package being inspected can be detected by the reading device 34 at the unloading position.

Further, where a package having passed the inspecting station 8 is to be directed to any of the stock lines 14*a* to 14*c* for accepted products, a reading device 62 may be located just forwardly of a taking-in position of one of the stock lines nearest to the inspecting station.

In particular, in case information read by the reading device 62 indicates the third span SP3 of the winder W2 and accordingly the package is to be directed to the stock line 14*b*, the package P passes by the entrance of the line 14*a* and is then abutted with and stopped by a stopper not shown waiting at the package pulling off position of the stock line 14*b* whereafter it is pulled off the tray and transferred to the line 14*b* by the package transferring device 15.

It is to be noted that where there are a large number of stock lines, the reading device may be located intermediate the transport path 13 in order to allow a plurality of packages to be transported at a time into the transport path 13. While the stock lines 14*a* to 14*c* are shown arranged in a plane in the layout of FIG. 1, it is also possible to arrange them otherwise in a plurality of different stages in a vertical direction. In such a case, if part of the transport path 13, that is, a conveyor for a package is separated and moved in parallel in a vertical direction as in an elevator, then a package can be fed to an appropriate one of the stock lines in an appropriate one of the stages.

Figure 8:
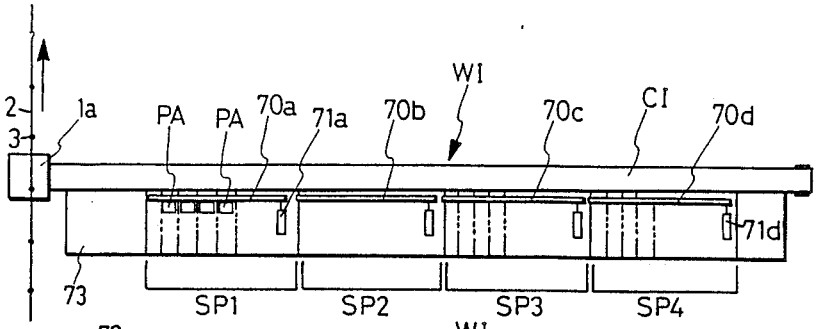
FIGS. 8 to 10 are schematic views illustrating an example of doffing method at a winder of a system in which a source of a package is identified as a span of the winder.
Figure 9:
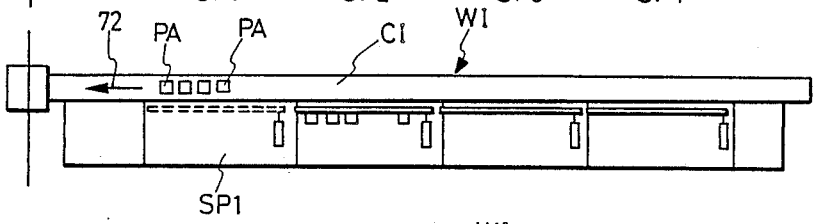
Figure 10:
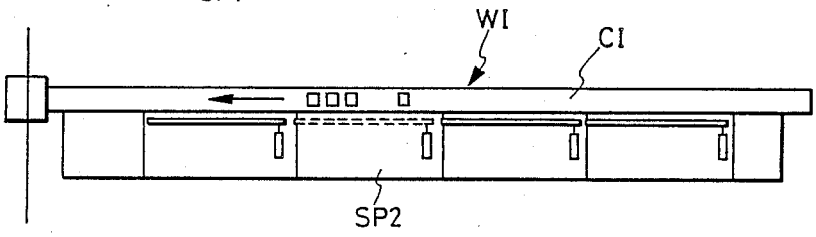

Now, operation of the system described above will be described. An exemplary one of automatic winders which can be conveniently applied to the present system is shown in FIGS. 8 to 10. In particular, the automatic winder W1 includes a large number of winding units divided into 4 groups each including a plurality of winding units. Such a group is called "span", and thus the automatic winder W1 shown is constituted from 4 spans SP1 to SP4. Each span has a stock device 70*a*, 70*b*, 70*c* or 70*d* provided therefor in which fully wound packages are to be stored temporarily. The stock device includes a stock bar extending over the entire span, and a stock bar operating source such as a hydraulic cylinder 71*a*, 71*b*, 71*c* or 7*d* having a position in which it contacts the stock bar with packages and movable away from the packages to discharge the stored packages at a time onto a conveyor Cl. Operations of the cylinders 71*a* to 71*d* are effected either in a sequence or at random for the individual spans. For example, it is assumed that, in FIG. 11, the average winding time T required to wind up a fully wound package is set to 60 minutes, and the opening operating time interval t for the stock bars is set to 50 minutes while the time lag dt, that is, the time interval after operation of the stock bar for a certain span until subsequent next operation of the stock bar of the same span is set to 10 minutes.

Now, at the span SP1 of FIG. 8, the hydraulic cylinder 71*a* is actuated to operate the stock bar 70*a* so that a plurality of stored packages PA are discharged at a time onto the conveyor C1, and as the conveyor C1 is circulated, the packages are transported in a direction of an arrow mark 72 to the position of the lifter 1*a*. Then, the packages PA are transferred one after another to hangers 8 above by the lifter 1*a*. In this instance, each time a package PA is transferred, identifying marks indicative of the span SP1 are written on the indicating member 33 of the hanger by the writing device 32*a*. Thus, the packages being fed at present on the conveyor as a result of operation of the hydraulic cylinder 71*a* for the span SP1 are identified as packages which have been produced on the span SP1, and the writing device 32*a* is instructed so that such identifying marks may be written by a controlling device 73 on the winder side.

It is to be noted that it is necessary that the time required for transfer of packages for one span to hangers be set such a time dt specified as above in order to avoid an error in numbering.

Figure 11:
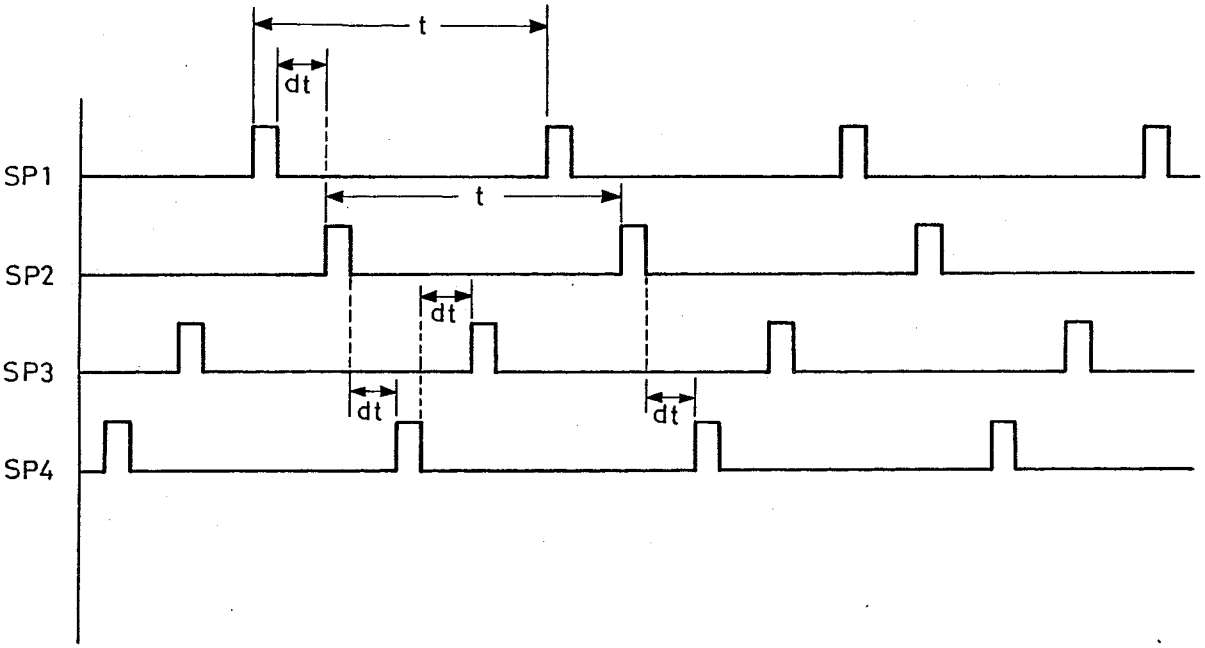
FIG. 11 is a time chart of the doffing method of FIGS. 8 to 10, FIGS. 12 and 13 are schematic views illustrating an example of doffing method at a system in which a source of a package is identified as a winding unit.

After completion of transportation of the packages from the span SP1, the stock bar for the span SP2 is operated as shown in FIGS. 10 and 11 so that packages PA2 which have been doffed on the span SP2 are discharged at a time onto the conveyor C1. The packages PA2 are then transported in a similar manner in the direction of the arrow mark 72 and then transferred one by one to the overhead conveyor 2 by the lifter 1*b*. In this instance, information that the packages come from the span SP2 is transmitted from the controlling device 73 to the writing device 32*b*, and consequently identifying marks indicative of the span SP2 are written on the indicating members 33 of the hangers.

In this manner, fully wound packages discharged from the winders W1 to W3 are transferred one after another to the hangers 3 of the overhead conveyor 2 and thus transported together with identifying marks indicative of the winders and the spans on which the individual packages have been produced.

When such a package arrives at the unloading position of FIG. 1, it is transferred from a hanger to a tray T on the conveyor belt 6 which extends to the inspecting station 8. Thereupon, the identifying marks indicated on the hanger on which the package to be unloaded has been carried are read by the reading device 34, and a central controlling device 74 instructs a writing device 75 to write the same identifying marks on the indicating member (49 of FIG. 6) on the tray T on which the package is to be fitted. In this manner, the identifying marks are transferred by the writing device 75.

Consequently, a span on which a package on a tray T has been produced is indicated on the tray T. Accordingly, the source of the package on the tray can be identified by a reading device located at the package inspecting device 8 or at a suitable location of a transporting line or a reservoir line for reading such identifying marks on a tray.

Figure 12:
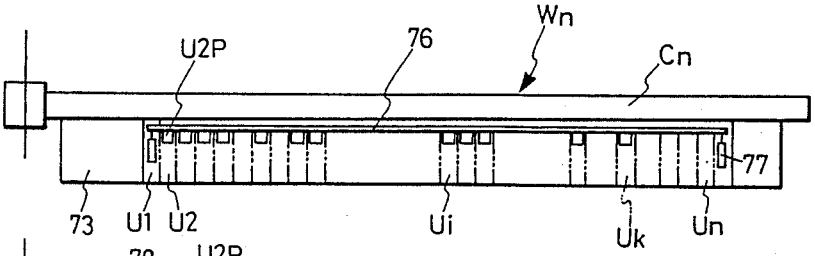
Figure 13:
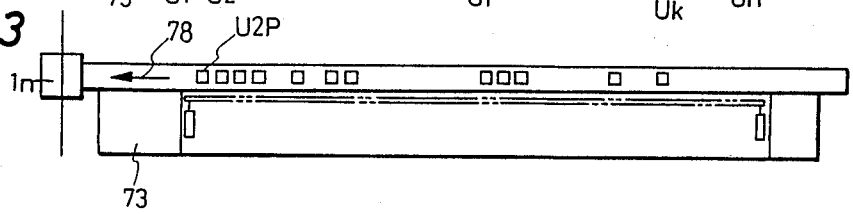

FIGS. 12 and 13 illustrate an example of doffing method for enabling identification of a winding unit being the minimum unit of a winder as a source of a package. In particular, a stock bar 76 is provided which extends over all winding units Ul to Un of a winder Wn as shown in FIG. 12. The stock bar 76 is operated by a hydraulic cylinder 77 to move doffed packages at a time onto a conveyor Cn. In this instance, information is stored into a memory within the controlling device 73 by a metering device provided for the winder regarding on which units the packages which have been doffed between the present operation and a direct preceding operation of the stock bar have been wound up or produced. Accordingly, since all the packages transferred to the conveyor Cn are transported in a direction of an arrow mark 78 without changing their order as seen in FIG. 13, a corresponding relationship between a package transported to the position of the lifter ln and the unit on which the package has been doffed among the winding units Ul to Un can be established at the position of the lifter ln. In particular, in the case shown, a package U2P which has been produced on the unit U2 is transferred at first to a hanger, and then a package from the unit U3 is transferred. In this manner, a package from the unit Uk is transferred at the end. The identifying marks for the units stored in the memory within the controlling device 73 are then written successively on the indicating members on hangers of the overhead conveyor 2.

Naturally, the methods of identifying sources of packages discharged from the winder on the span basis and on the winding unit basis are not limited to such methods as described above, and various other methods may possibly be employed. Naturally, such identifying methods vary depending upon a type of an automatic doffing system of a winder.

A package transported to the unloading position 5 by the overhead conveyor 2 is then transferred to a tray T in such a manner as described hereinabove and then information of a source of the package is written onto the tray. Then, the package is transported together with the tray and then checked for its shape, weight, numbering and so on at the inspecting station 8 by a known inspecting device. As source information on the tray on which a package which is determined as rejected as a result of inspection conducted at the inspecting station 8 is fitted is read, the number of the winder and the number of the span or winding unit on which the package has been wound up can be identified.

Results of inspection at the inspecting station are processed by a processing device **8*a***. This allows listing up of such results of inspection of packages of various types, and accordingly a source at which rejected packages have been produced frequently can be identified readily.

Now, an embodiment of such package transferring devices **15*a* to 15*d* as described above will be described with reference to FIGS. 14 to 18**.

Figure 14:
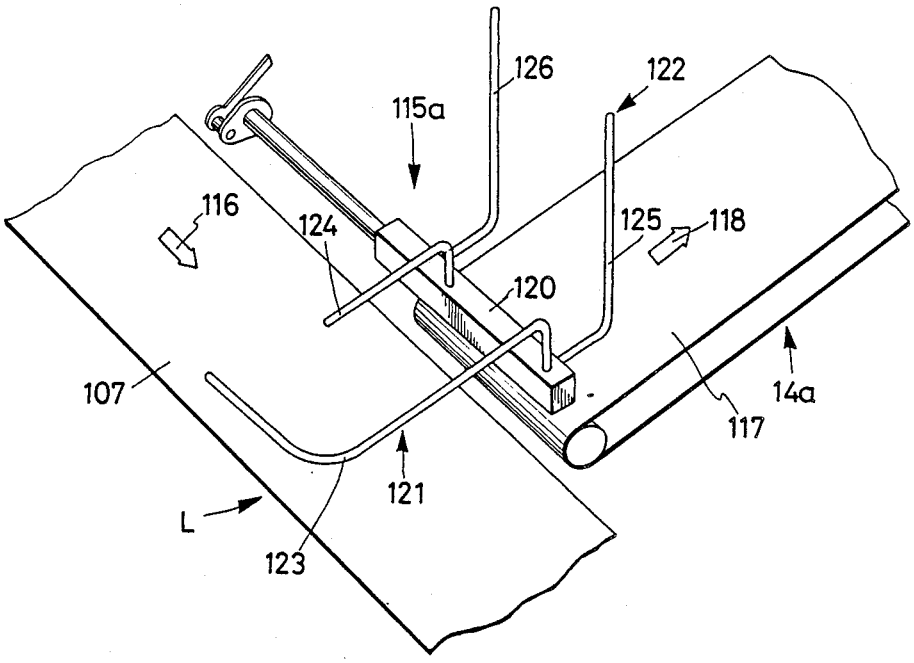
FIG. 14 is a perspective view of general construction showing a package transferring device (15*a* to 15*c*), FIG. 15 a plan view of the package transferring device of FIG. 14, FIG. 16 a front elevational view of the package transferring device of FIG. 14, FIG. 17 an illustration showing operation of the package transferring device of FIG. 14, and FIG. 18 a side elevational view showing first and second supporting members (121, 122) when a package is transferred to a conveyor (117).
Figure 15:
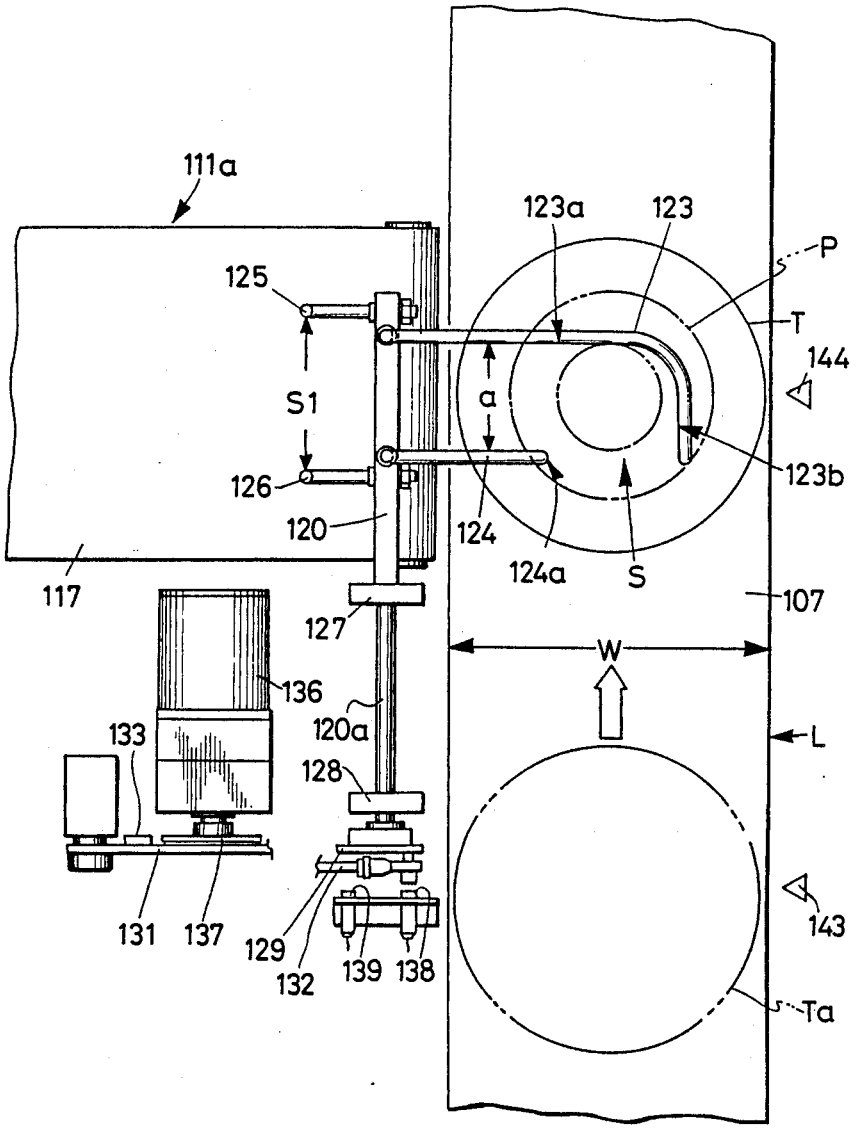

Referring to FIG. 14, a package transferring device **115*a* is located at a branch point from which a conveyor belt 117 which is circulated in a direction of an arrow mark 118 and constitutes a branch line 14*a* extends in a perpendicular direction to another conveyor belt 107 which is circulated in a direction of an arrow mark 116 and constitutes a main transport line L. The package transferring device 115*a* includes a shaft 120 which is rotated in opposite directions by a driving mechanism which will be hereinafter described. The package transferring device 115*a* further includes first and second package supporting members 121 and 122 both mounted on the shaft 120. The first supporting member 121 includes a pair of support rods 123, 124 which extend above the main transport line L for receiving thereon a package on a tray being fed on the conveyor while the second supporting member 122 includes a pair of support rods 125, 126 of the same shape for receiving thereon a package from the first supporting member 121 and for transferring the package to the branch line 14*a*. The support rods 123, 124 of the first supporting member 121 and the support rods 125, 126 of the second supporting member 122 are secured to the shaft 120 with a difference of about 90 degrees in phase. Referring to FIG. 15, the rod 123 of the rods 123, 124 constituting the first supporting member 121 has formed thereon a portion 123*a* which extends in a direction opposite to the branch line 14*a* and perpendicular to the direction of circulation of the conveyor 107 to a position farther than the center of the width W of the conveyor 107, and another portion 123*b* which is integral with the portion 123*a* and is bent or extends in a direction toward the upstream side of the conveyor 107 and substantially in parallel with the direction of circulation of the conveyor 107. The other support rod 124 extends from the shaft 120 to a position between the widthwise center of the conveyor 107 and the branch line 14*a* so that a distance S sufficient to allow a winding pipe (K of FIG. 16) of a package to pass therethrough may be provided between an end 124*a* of the support rod 124 and the bent portion 123*b* of the support rod 123. Further, the distance a between the rod portion 123*a* and the rod 124** is greater than the diameter of an end portion Kl of a package winding pipe and smaller than the diameter of an end face Pa of a package.

Meanwhile, the two rods 125, 126 constituting the second package supporting member 122 are secured to the shaft 120 with a phase difference of about 90 degrees from the rods 123, 124. The rods 125, 126 are spaced from each other by a predetermined distance Sl which is smaller than a minimum diameter of a package so that they may contact with an outer peripheral phase of a layer of yarn of a package placed thereon.

The shaft 120 on which the first and second package supporting members are mounted is located above an end portion of the conveyor 117 of the branch line **14*a* as seen in FIG. 15 and has an axis extending perpendicularly to the direction of circulation of the conveyor 117**.

Figure 16:
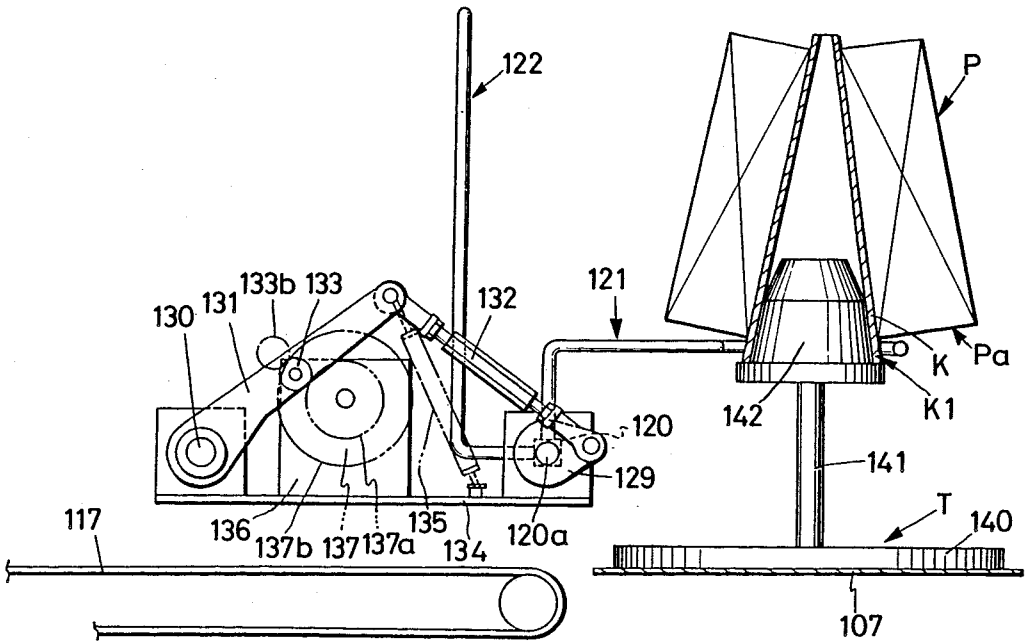

The shaft 120 is supported at a portion 120*a* thereof for rotation by means of a pair of bearings 127, 128, and a lever 129 is fixedly mounted at an end portion of the shaft 120 as shown in FIG. 16. A rod 132 is connected between the lever 129 and a cam lever 131 supported for pivotal motion on a fixed shaft 130. A cam follower 133 is supported at an intermediate portion of the cam lever 131, and a spring 135 extends between an end portion of the lever 131 and a stationary frame 134. The cam follower 133 is held in engagement with a cam plate 137 which is connected to be driven by a motor 136. Accordingly, as the cam plate 137 is rotated, the cam follower 133 is displaced between a full line position and a two dot chain line position 133*b* by a smaller diameter portion 137*a* and a greater diameter portion 137*a* of the cam plate 137, respectively, so that the lever 129 secured to the shaft is pivoted by 90 degrees via the cam lever 131 and the rod 132. Consequently, the shaft 120 is rotated by 90 degrees and thus pivots the first and second supporting members 121, 122 of FIG. 16 by 90 degrees around the axis of the shaft. It is to be noted that contactless sensors 138, 139 of FIG. 15 are provided to detect such pivotal motion of the lever 129 by 90 degrees to control energization and deenergization of the motor.

Now, operation of the package transferring device having such a construction as described above will be described.

It is to be noted that an example of tray T for transporting a package independently one by one is shown in FIG. 16. In particular, the tray T includes a base plate 140 in the form of a disk adapted to be placed on the conveyor 107, a support post 141 erected uprightly on the base plate 140, and a peg 142 secured to the support post 141 for receiving a package thereon. The shape of the peg 142 is determined suitably depending upon the shaft of a winding pipe K of a package to be handled.

Figure 17:
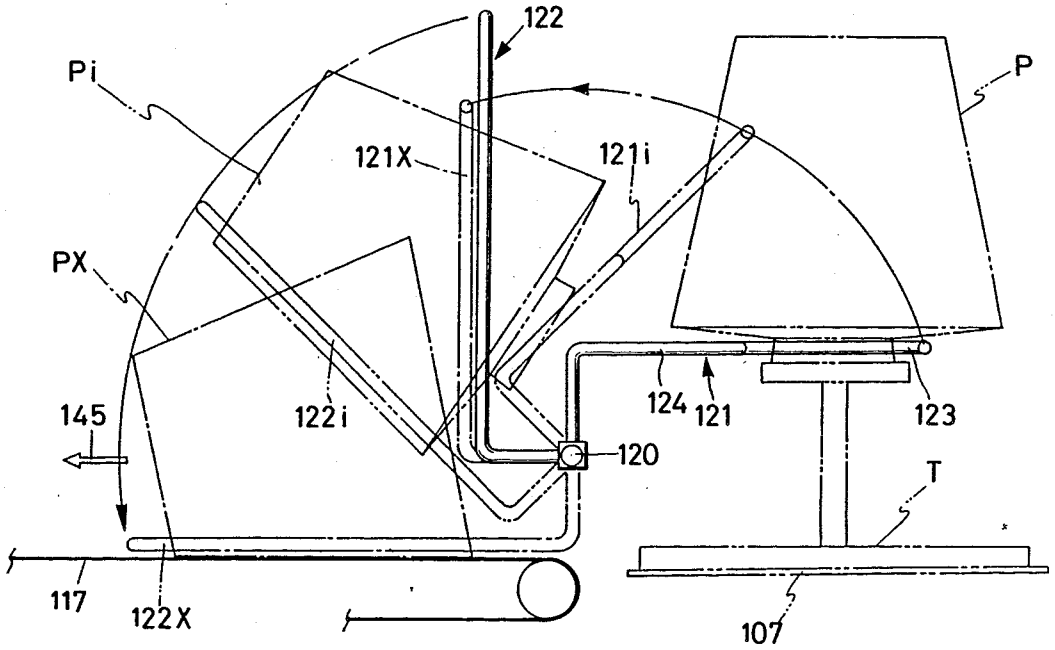

Referring to FIG. 17, the first supporting member 121 and the second supporting member 122 of the transferring device normally assume their respective alternate long and short dash line positions 121X, 122X. When a package P integral with a tray T is fed on the conveyor 107 and comes to a certain position Ta on the upstream side of the branch line 14*a* of FIG. 15, a package detecting device such as a photoelectric tube sensor 143 will detect the package. In response to such a detection signal from the package detecting device, the motor 136 is energized so that the supporting members 121, 122 are pivoted from the respective alternate long and short dash line positions 121X, 122X to their respective full line positions 121, 122 in order to accept the package thereon.

When the tray T integral with the package comes to a position T of FIG. 15, the take-up tube K of the package passes through the gap S between the rods 124, 123 and is abutted with the portion 123*a* of the rod 123 so that the package is compulsorily stopped at such an abutted position. Thus, when a sensor 144 detects the package P, the motor 136 is driven to rotate now in the reverse direction so that the shaft 120 is rotated by 90 degrees in the counterclockwise direction by way of a transmitting mechanism including the cam 137, cam lever 131, rod 132 and so on shown in FIG. 16.

Accordingly, the supporting members 121, 122 of FIG. 17 are pivoted back to their respective alternate long and short dash line positions passing intermediate positions. Thereupon, the package P on the tray T is pulled off the peg 142 of the tray T and moved along a pivoting path by the first supporting member 121. As the first supporting member 121 is pivoted, the package will slip on the rods 123, 124 until it is received by the rods 125, 126 of the second supporting member 122. Thus, at the respective intermediate positions 121*i*, 122*i* of the first and second supporting members 121, 122 of FIG. 17, the package Pi is transferred at an outer peripheral surface of a layer of yarn thereon to the rods 125, 126 of the second supporting member 122*i*. As the shaft 120 is rotated further until the rods 125, 126 are pivoted to a position near above the branch line 14*a*, the package Pi on the rods 125, 126 is placed onto the conveyor 117. Consequently, as the conveyor is circulated, the package Px is fed in a direction of an arrow mark 145 together with the conveyor away from the rods 125, 126, thereby completing transfer of the package from the main transport line L to the branch line 14*a*.

Figure 18:
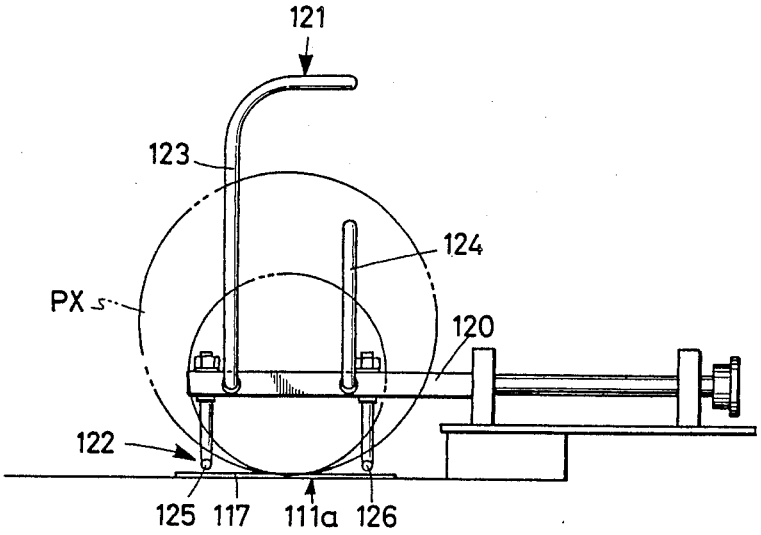

It is to be noted that FIG. 18 shows positions of the first and second supporting members 121, 122 when a package is placed onto the branch line 14*a*. In the positions of the supporting members 121, 122, there is a gap between the package PX and the rods 125, 126, and accordingly the package is no more supported on the second supporting member but is placed on an upper face of the conveyor. Thus, if the conveyor 117 is circulated in this condition, the surface of the yarn layer on the package can be separated from the transferring device without contacting with the rods 125, 126. Also, a gap appears between the rods 125, 126 of the second supporting member 122 and the upper face of the conveyor 117 of the branch line so that the upper face of the conveyor may not contact with the rods. It is to be noted that preferably the conveyor 117 is fed in an intermittent stepwise manner by a pitch corresponding to one package. If the conveyor 117 is circulated by one pitch each time a package is placed onto the branch line, packages can be stored regularly on the branch lines 14*a* to 14*c* as shown in FIG. 1 while surfaces of the packages are not abraded by the upper face of the conveyor.

It is to be noted that while it is possible to keep the tray T in FIG. 15 stopped by means of a stopper when the package P on the tray T in FIG. 15 is to be pulled off, in the present embodiment, the tray is compulsorily kept stopped by the first supporting member 121 against which the package is pressed by the force of circulation of the conveyor belt 107. Accordingly, after the package P is pulled off the tray T as shown in FIG. 17, the emptied tray is automatically fed on the conveyor 107.

Accordingly, a package on a tray being transported on the main transport line can be separated from the tray and transferred to the branch line, and the thus emptied tray is fed back to the package fitting position while only the package is transferred to the branch line. Accordingly, transfer of a large number of packages can be effected without preparation of a large number of trays, which allows saving of a space for a transport line and a branch line.

As apparent from the foregoing description, according to the present invention, while a package produced on an automatic winder is transported to an inspecting station, it can be transported in an integral relationship with a transport medium on which a source of the package is indicated. Accordingly, a source, that is, a winder or a winding unit at which rejected packages are produced frequently can be identified. Accordingly, the inspecting step for packages enables not only judgment of whether a package is allowable or to be rejected but also management of a winder or winders.

What is claimed is:

1. In a system for transporting a yarn package wound by a winder, the improvement comprising package transporting apparatus, comprising:

transport media for independently transporting packages thereon and for being fed along a transport line between a winder and an inspecting station, wherein said transport media comprise a hanger hung on a chain which travels along a track and a tray which carries a package erected thereon and is transported on a conveyor, wherein said hanger and said tray are provided with a source indicating member which indicates a source of a package which is to be placed on the respective hanger or tray, and a device for writing on or reading from said indicating members is arranged at a suitable location of said transport line in order to identify a source of each package, wherein said hanger has at least one pair of package supporting rods which extend in a direction substantially parallel to the direction of movement of said hanger and are spaced by a predetermined distance from each other, whereby a package is transported in a condition wherein an outer peripheral surface of a layer of yarn on the package is placed on said supporting rods, wherein a full wound package doffed from a winder is transferred by the hanger and then the package is unloaded from the hanger and fitted on and erected on a tray for transporting a package at a position of an unloading device, wherein a reading device for reading the identifying member of the hanger and a writing device to write the same identifying marks as read from the hanger on the identifying information indicating member of the tray are provided at the position of the unloading device.

2. The system as claimed in claim 1, wherein said hanger comprises a base plate at an upper portion thereof, package support members are secured to a lower face of the base plate and a pair of package placing rods connected between lower end portions of the support members, an identifying member being provided on the upper face of said base plate as the source indicating member.

3. The system as claimed in claim 2, wherein said identifying member is formed from a freely magnetizable and demagnetizable rubber magnet.

4. The system as claimed in claim 3, wherein writing devices for the identifying member are respectively provided for the package delivery positions where a package doffed from a winder is loaded on hanger.

5. The system as claimed in claim 1, wherein said tray includes a base member in the form of a disk and a peg formed on the base member for receiving a bobbin thereon and is formed as a unitary member from a non-conductive materials.

6. The system as claimed in claim 5, wherein an annular groove is formed on an upper face of the base member of the tray and the identifying information indicating member which is the form of a rubber magnet sheet is fixedly mounted in the groove.

7. A system for transporting a package wound by one of a plurality of winders, the system comprising:

a first package conveyor having a package supporting hanger on which the package may be supported and conveyed;

a package source identifying member, associated with the hanger, for identifying the winder by which the package was wound;

a tray adapted to support the package, the tray having information storage apparatus associated therewith;

an unloading device for unloading the package from the hanger and transferring the package to the tray;

reading means for reading the package source identifying member to identify the winder by which the package was wound; and writing means for writing into the information storage apparatus source information corresponding to the winder identified by the package source identifying member.

8. A system as claimed in claim 7, wherein the package source identifying member comprises a magnetizable element supported by the hanger.

9. A system as claimed in claim 8, wherein the information storage apparatus comprises a magnetizable member supported by the tray.

* * * * *